US009993687B2

(12) United States Patent
Serlachius

(10) Patent No.: US 9,993,687 B2
(45) Date of Patent: Jun. 12, 2018

(54) WHEELCHAIR EXERCISE DEVICE

(71) Applicant: Jarl Fredrik Serlachius, Kauniainen (FI)

(72) Inventor: Jarl Fredrik Serlachius, Kauniainen (FI)

(73) Assignee: SPINEGYM OY, Koskenkylan Saha (FI)

( * ) Notice: Subject to any disclaimer, the term of this patent is extended or adjusted under 35 U.S.C. 154(b) by 0 days. days.

(21) Appl. No.: 15/120,541

(22) PCT Filed: Feb. 25, 2015

(86) PCT No.: PCT/FI2015/000006

§ 371 (c)(1),
(2) Date: Aug. 22, 2016

(87) PCT Pub. No.: WO2015/128538

PCT Pub. Date: Sep. 3, 2015

(65) Prior Publication Data

US 2017/0065847 A1 Mar. 9, 2017

(30) Foreign Application Priority Data

Feb. 25, 2014 (FI) ..... 20140055

(51) Int. Cl.
*A63B 21/02* (2006.01)
*A63B 21/04* (2006.01)
(Continued)

(52) U.S. Cl.
CPC ..... *A63B 23/02* (2013.01); *A61G 5/10* (2013.01); *A61G 5/1091* (2016.11);
(Continued)

(58) Field of Classification Search
CPC . A61B 23/02; A61B 23/0205; A61B 23/0211; A61B 23/0233; A61B 23/0238; A61B 21/1609; A47C 9/002
See application file for complete search history.

(56) References Cited

U.S. PATENT DOCUMENTS 2,667,913 A * 2/1954 Dustin ..... A61H 3/00 297/252
2,667,917 A 2/1954 Dustin
(Continued)

FOREIGN PATENT DOCUMENTS

WO 2005115560 12/2005
WO WO 2005115560 A1 * 12/2005 ..... A63B 21/04
(Continued)

*Primary Examiner* — Nyca T Nguyen

(57) ABSTRACT

A wheelchair exercise device comprising two assemblies, each assembly comprises: a seat plate; a longish pipe element; and a wide belt. The seat plate is L-shaped and made of hard material, the longish pipe element is flexible and has padding on its top side, the longish pipe element mounted onto ferrule or hole integrated approximately in the middle of the vertical edge of the L-shaped seat plate, the first end of the wide belt is attached to the longish pipe element and adjustable upwards, downwards and around the pipe of the longish pipe element, and the second end of the wide belt has hook and loop fastener. The two assemblies are adapted to be fastened onto each other by the hook and loop fasteners, and the assemblies are designed so that the combined measurement of both the width and length of the seat plates is smaller than the measurement of a wheelchair seat, thereby allowing the width and vertical adjustment of the location of the seat plates on the wheelchair seat.

2 Claims, 3 Drawing Sheets

(51) Int. Cl.
*A63B 23/02* (2006.01)
*A61G 5/10* (2006.01)
*A63B 21/16* (2006.01)

(52) U.S. Cl.
CPC ..... *A63B 21/026* (2013.01); *A63B 21/04* (2013.01); *A63B 21/1609* (2015.10); *A63B 23/0211* (2013.01); *A63B 23/0233* (2013.01); *A63B 2208/0233* (2013.01); *A63B 2209/10* (2013.01)

(56) References Cited

U.S. PATENT DOCUMENTS 4,565,409 A * 1/1986 Hollonbeck ..... A47C 16/00 297/411.1
5,224,924 A * 7/1993 Urso ..... A61F 5/024 135/71
5,462,518 A * 10/1995 Hatley ..... A61F 5/024 482/124
6,015,395 A * 1/2000 Kautzky ..... A61H 1/0229 602/19
6,315,750 B1 * 11/2001 Gray ..... A61F 5/026 602/32
6,520,587 B2 * 2/2003 Noiseux ..... A47C 1/03 297/173
7,156,465 B2 * 1/2007 Stewart, III ..... A47C 7/021 297/230.1
7,416,257 B1 * 8/2008 Lakhman ..... C07D 471/04 297/230.1
9,480,341 B2 * 11/2016 DiPaolo ..... A47C 7/546

FOREIGN PATENT DOCUMENTS

WO 2007144712 12/2007
WO 2010089447 8/2010
WO WO 2010089447 A1 * 8/2010 ..... A47C 7/402

* cited by examiner

WHEELCHAIR EXERCISE DEVICE

The invention comprises an exercise device for abdominal and back muscles fastened onto a wheelchair.

There exists a numerous amount of various exercise and rehabilitation devices for the so-called normal, healthy people, but, for the disabled tied to a wheelchair, there are astonishingly little offered for taking care of one's own condition. In practice, a wheelchair patient has to get up from the wheelchair and fit into the exercise equipment that is not at all designed with mobile disability in mind. It is not possible for a wheelchair patient to move over to the exercise equipment, and the same holds true when the patient has to move from one device to another and finally back to the wheelchair.

For all parties concerned, the most practical solution is that the person can do the exercised in the wheelchair. But today, the possibilities for this are very limited. Even such simple equipment as dumb bells is difficult to handle when sitting in the wheelchair. Light devices, such as rubber loops, springs, and gym balls that can be lifted from a table, are the most popular exercise equipment, but, for example for exercising abdominal and back muscles, their exercise possibilities are very limited or non-existent. Up to today, mostly a large ball held tightly with arms and pushed against the upper body has been used to strengthen the abdominals. This method offers a satisfactory exercise for the abdominals, but there exists no method to exercise the back muscles in a wheelchair.

There is a Finnish invention, PCT/FI2010/000008 by Serlachius, designed for physically independent users, and, within the sphere of the invention, there is a solution intended to be fastened on top of a traditional seat. In principle, it could be mounted onto a wheelchair, but, the result of an empirical study was that persons having to use a wheelchair consider it to be a holy place, a part of their home and no extras are allowed to spoil its comfortableness. For a short while, detachable exercise equipment may be allowed in it, but there is no way any permanent extra exercise equipment is allowed in it. As the patient has to remove him/herself from the chair, the detachable seat designed by Serlachius is considered to be in the group with last-mentioned equipment. Also, as it spoils the comfortable sitting position that is the most important requirement among the attributes of a wheelchair for a patient, it is not suitable as a permanent part of a wheelchair.

The invention presented here provides a solution for this problem by introducing an exercise device intended for wheelchair patients for strengthening abdominal and back muscles characterized in that the device consists of two separate flat, straight, plate-like seat plates, preferably of oval shape, made of hard, light, slippery material, and there is a longish, flexible, preferably pipe-like element cushioned on its top part mounted into a ca. 5-15 cm ferrule or hole on the side integrated into ca. the middle of the outside edge of those plates, and the element has a sturdy, wide belt half, allowing adjustment along the body of the element, and the ends of the elements' belt halves can be fastened onto each other with Velcro, and the width and vertical adjustment of those elements is arranged so that the combined measurement of both the width and length of the seat plates is smaller than the measurement of the wheelchair seat, thereby allowing the width and vertical adjustment of the location of the seat plates.

In this solution, as the seat part of the device consists of two separate, flat, straight, plate-like parts, without having to stand up from the wheelchair, by slightly tilting his or her buttocks on one side at a time, it is easy for the person in the wheelchair to push the parts one after another under his or her buttocks or under the wheelchair cushion. In order for the parts to form a sturdy exercise base, the size of the seat plates must cover as much of the wheelchair seat as possible, but so that, taking into consideration persons' different buttock sizes, there is enough width and vertical space in the wheelchair seat for moving, i.e., for adjustment.

More support is achieved by equipping the plates with an outer edge rising 5-15 cm up in a 90-degree angle, onto which a ferrule can be excellently mounted, and the exercise device's detachable longish, flexible elements with padding on the top and with a pipe-like basic form can be fastened onto the ferrule by pushing.

A belt half, adjustable up and down along the element body, is also mounted onto both of the elements. A good way to implement the belt's longish adjustment is to fasten both longish elements' belt half to the desired length with Velcro.

All flexible plastics as well as metals and their various combinations are suited as material for the longish elements. Naturally, wood can be an excellent choice, but, for economic reasons, wood is an unprofitable solution for this. All light, durable, slippery materials, such as plastic and light metal, are suited for making the flat parts, but, when investing in individuality and articrafts, also wood is possible. However, when it comes to economic mass production, plastic materials are superior.

Special sets could be made of wood and fiber glass, with the pipes and the flat plates forming one piece. For this, only one work phase is required, with the finished product as the final result.

Because body sizes vary, the device must be adjustable in length and width. As already mentioned, the width and vertical adjustment is done by moving the location of the seat plates on the wheelchair seat. The best method for longish adjustment is to use the telescopic technique, in which the longish element consists of pipes where the top part or parts go inside the pipes below, this way adjusting the pipe's length.

The longish elements can also be made flexible by mounting them flexibly, for instance, with a coil spring instead of a rigid ferrule.

For deep abdominal muscle exercising, the actual exercise is done with the person sitting on top of the seat plates so that, without preliminary tensing, the longish elements with the padding go in place against the shoulders, and the belt length is adjusted so that, when in place, it touches the lumbar region. This way, a person is able to bend his or her upper body forward against the resistance coming from the pipes, with the belt offering counterforce. The movement is returned to the starting position. This exercise is performed as many times as desired When, using the same principle, the element paddings are placed behind the shoulders and the belt is placed to support the lower abdomen, the person is able to bend his or her upper body backwards against the resistance coming from the longish element, this way exercising the deep back muscles. The body is returned to the starting position and the exercise is performed the required number of times.

Compared to the prior art, the seat place to be placed on a regular chair (PCT/FI2010/000008) by Serlachius to be mostly reckoned with, there are two most fundamental differences.

For two reasons, the prior art's seat plate is a solid piece that cannot be inserted into or placed on the chair when a person is sitting:

The seat plate is not flat; instead, it is intended to simulate the comfortable seat of a finished chair that entirely lacks one of the most important attributes existing in the seat plate in question here. The seat plate must be flat, straight, light, and slippery so that it can be pushed under a person's buttocks when the person is sitting.

The other attribute that cannot be compromised is that the seat plate must be made of two pieces with the aforementioned attributes. Even if the seat plate were to meet the requirements set for those materials and form but would be one solid piece, it would be almost impossible to push it under a person when the person is sitting in a wheelchair. In other words, for the device to work, it is imperative that it is made of two pieces. When the seat plate is made of two parts, it is easy to put the seat plate halves in place from the side when the person tilts his or her buttocks on one side at a time.

As already stated above, these two characteristics or attributes imperative for the functioning of the exercise device in question here are totally lacking in the Serlachius patent #PCT/FI2010/000008.

The following is a presentation of the invention, with reference to the attached drawings, in which FIG. 1 shows separate seat plates (1) that have the longish elements (2), with padding (3), attached onto them and the belt halves (5,5 A).

Figure 4:
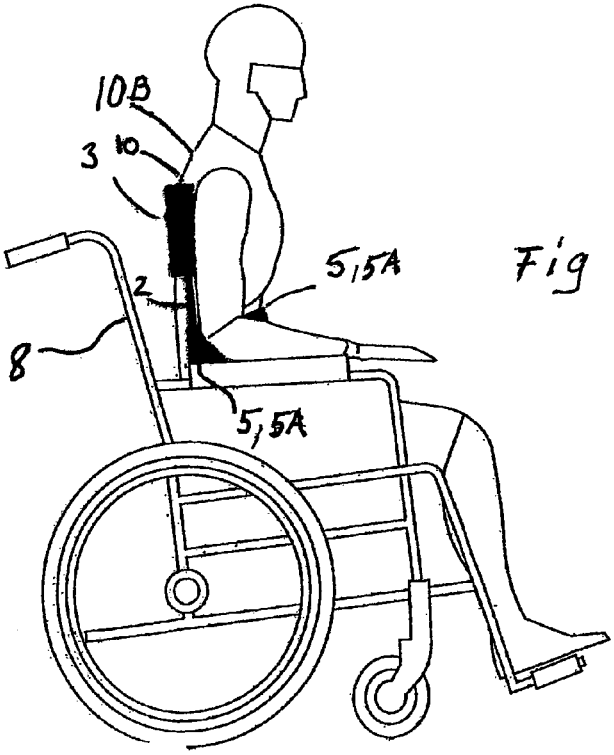

FIG. 4 presents a person sitting in the natural position (10B) with the straight back about to start back muscle exercise with the elements' (2) padding parts (3) behind the shoulders (10) and the belt (5,5A) against the lower abdomen.

Figure 5:
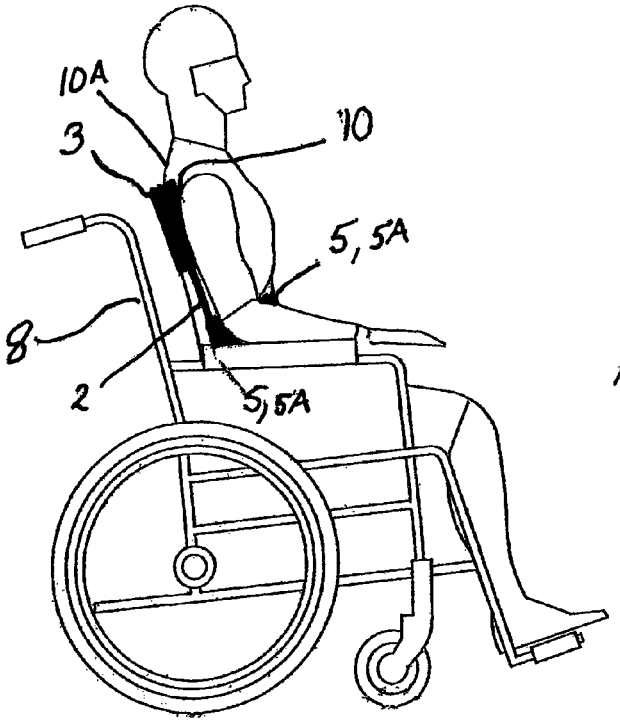

FIG. 5 shows a person having started back muscle exercise (10A) by bending the upper body backward.

Figure 1:
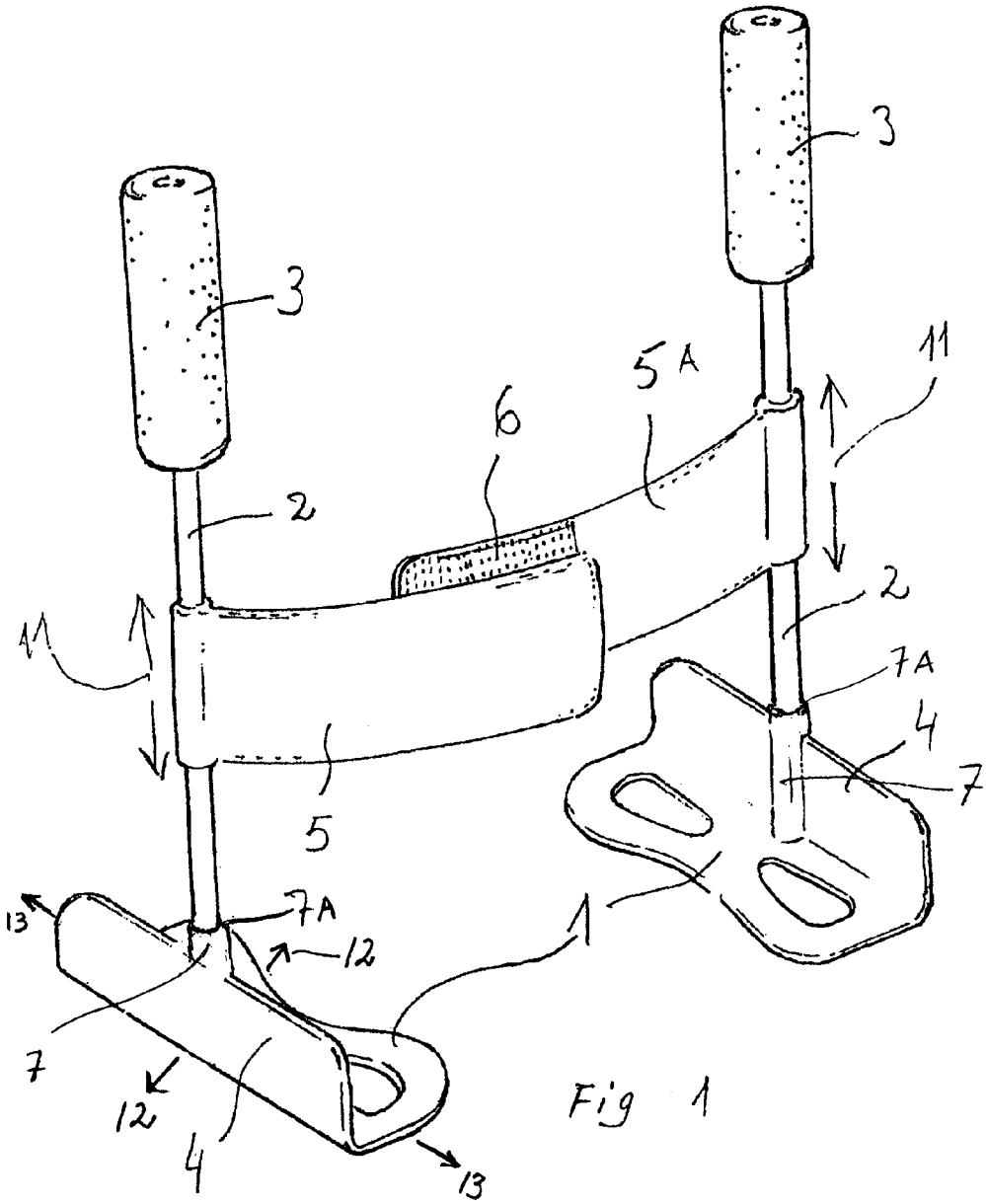

FIG. 1 shows an exercise device consisting of two flat seat plates (1) with the high edges (4), and a longish flexible element (2), with padding (3), is fastened onto a ferrule (7) integrated onto both of the edges (4), with the belt halves (5,5A) that can be fastened onto each other with Velcro (6), allowing adjustment up and down (11) the element.

Figure 3:
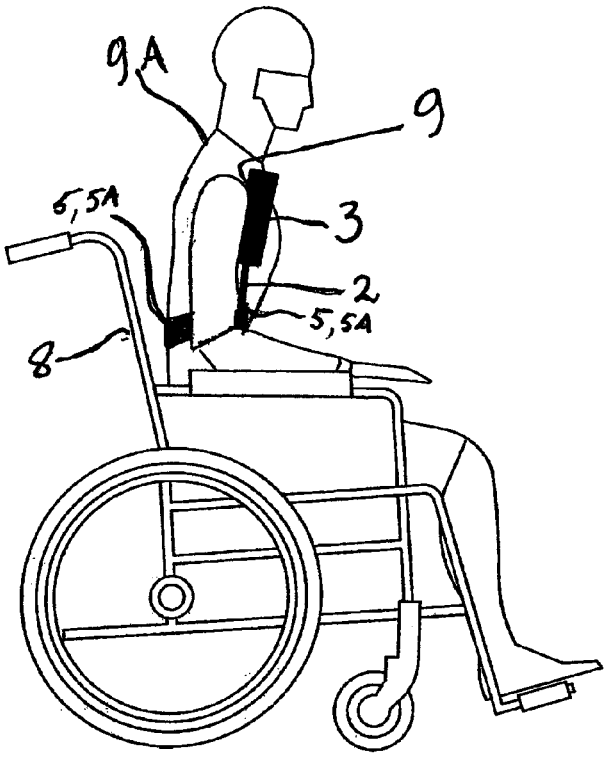
FIG. 3 shows a person having started abdominal exercise (9A) by bending the upper body forward.
Figure 2:
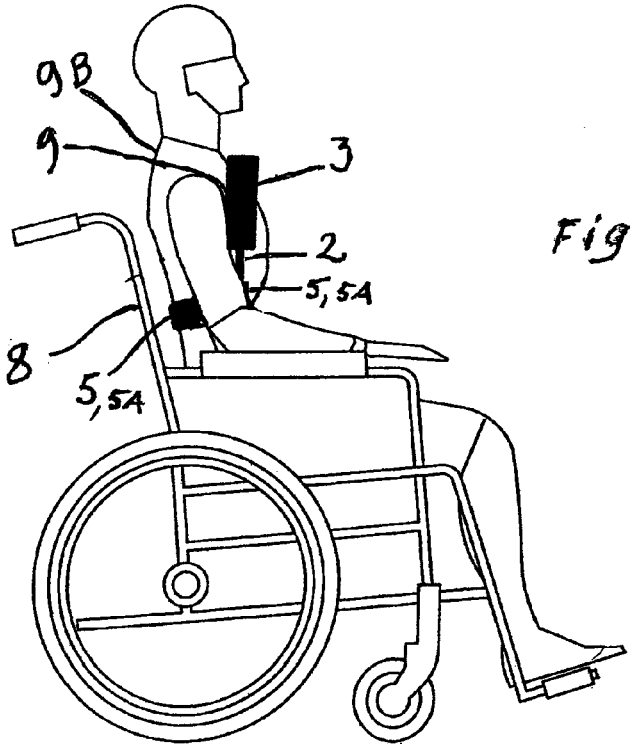
FIG. 2 illustrates an exercise device mounted on a wheelchair (8) and a person sitting in the natural position (9B) with the straight back about to start abdominal exercise with the elements' (2) padding parts (3) in front of the shoulders (9) and the belt (5,5A) behind the lumbar region.

FIG. 2 shows a person sitting in a natural position (9B) in a wheelchair (8) ready to start abdominal muscle exercise, and the paddings (3) are in front of the shoulders (9) and the belt (5,5A) touches the lumbar region. FIG. 3 shows a person having started abdominal muscle exercise (9A) by bending the upper body forwards, thereby allowing the forward-flexing elements (2) to generate resistance against the bending motion with the belt (5,5A) functioning as the counterforce.

FIG. 4 presents a person sitting in the natural position (10B) in a wheelchair with the straight back about to start back muscle exercise. In the back muscle exercise, the padding parts (3) are behind the shoulders (10) and the belt (5,5A) touches the lower abdomen.

FIG. 5 shows a person having started back muscle exercising (10A). The upper body is bent backwards and, as the flexible elements (2) bend, they generate resistance to the bending motion with the belt (5,5A) functioning as the counterforce against the abdomen.

The invention claimed is:

1. A wheelchair exercise device, comprising:

two parts, each part comprises:

a seat plate;

a longish pipe element; and a wide belt, wherein, the seat plate is L-shaped with a first plate part adapted to be located under a buttock of a person sitting on the wheelchair and a second plate part adapted to be located beside and outside the person sitting on the wheelchair and made of hard material, the longish pipe element is flexible and has padding on the element top side adapted to contact a shoulder of the person, the longish pipe element is mounted approximately in the middle of the edge of the second plate part of the L-shaped seat plate, a first end of the wide belt is attached to the longish pipe element and adjustable upwards, downwards and around the pipe of the longish pipe element, and a second end of the wide belt has hook and loop fastener, and wherein the two parts are adapted to be fastened onto each other by said hook and loop fasteners, and the two parts are designed so that the combined measurement of both the width and length of the seat plates of the two parts is smaller than the measurement of a wheelchair seat, thereby allowing the width and vertical adjustment of the location of the seat plates of the two parts on the wheelchair seat.

2. A The wheelchair exercise device according to claim 1, wherein the longish pipe element (2) and the seat plate are manufactured as one solid entity.

* * * * *